US007445540B2

(12) United States Patent
Reuter et al.

(10) Patent No.: US 7,445,540 B2
(45) Date of Patent: Nov. 4, 2008

(54) GUIDE MECHANISM FOR A TRACK-GUIDED TOY VEHICLE

(75) Inventors: Uwe Reuter, Althengstett (DE); Thomas Weidner, Besigheim (DE); Ralf Kroener, Bietigheim-Bissingen (DE); Cong-Uan Doan, Muehlacker (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 227 days.

(21) Appl. No.: 11/077,234

(22) Filed: Mar. 11, 2005

(65) Prior Publication Data

US 2005/0215173 A1 Sep. 29, 2005

(30) Foreign Application Priority Data

Mar. 11, 2004 (DE) ..... 10 2004 011 937

(51) Int. Cl.
*A63H 18/00* (2006.01)

(52) U.S. Cl. ..... 446/444; 446/446

(58) Field of Classification Search ..... 446/93–95, 446/429, 431, 436, 437, 444, 446, 448, 451, 446/465

See application file for complete search history.

(56) References Cited

U.S. PATENT DOCUMENTS 3,596,397 A * 8/1971 Colletti ..... 446/446
4,479,650 A * 10/1984 Neuhierl ..... 463/63
4,643,102 A * 2/1987 Arnau Manresa ..... 104/305
6,422,151 B2 7/2002 Maleika
6,752,684 B1 * 6/2004 Lee ..... 446/456

FOREIGN PATENT DOCUMENTS

DE 6605832 U 7/1970
DE 6608874 U 12/1971
DE 100 03 657 C2 8/2001
DE 697 07 025 T2 6/2002
EP 0 933 106 B1 8/1999

* cited by examiner

*Primary Examiner*—Nini F. Legesse
(74) *Attorney, Agent, or Firm*—Crowell & Moring LLP

(57) ABSTRACT

A guide mechanism for a track-guided toy vehicle which is equipped with an electric motor and can be operated on a road surface with a guide groove, engaging with a guide plate in the guide groove via a vertical axis of rotation on a chassis of the toy vehicle by means of a guide mechanism mounted on a chassis of the toy vehicle and being equipped with current collector elements for the electric motor, said collector elements cooperate with current rails in the road surface. A swing arm that is pivotable about a horizontal axis is arranged on the chassis of the toy vehicle which is placed upright on the road surface with the front wheels and rear wheels. The swing arm comprises the guide mechanism with the rotation axis, the guide plate and the current collector elements.

17 Claims, 5 Drawing Sheets

GUIDE MECHANISM FOR A TRACK-GUIDED TOY VEHICLE

BACKGROUND OF THE INVENTION

This application claims the priority of DE 10 2004 011 937.6, filed Mar. 11, 2004, the disclosure of which is expressly incorporated by reference herein.

This invention relates to a guide mechanism for a track-guided toy vehicle and, more particularly, to a guide mechanism in which the guide mechanism which is mounted via a vertical axis of rotation on a chassis of the toy vehicle engaging with a guide plate in the guide groove and being equipped with current collector elements for the electric motor, said current collector elements cooperating with current rails in the road surface.

DE 697 07 025 T2 discloses an electrically driven toy car having a chassis carried by wheels with an electric motor built into it. In the front end, a guide mechanism which protrudes with a flat journal into a guide groove of a road surface intended for the toy car is connected to the chassis. The flat journal is pivotable about a vertical axis. Brushes mounted on the guide mechanism are in constant contact with electrically conducting rails in the road surface.

A similar construction is disclosed in EP 0 933 106 B1. The guide mechanism of the electric motor-driven toy vehicle for track-guided racetracks disclosed therein has a joint in a front end area situated in front of a front axle. The joint is operative between a console of a chassis and a carrier of the guide mechanism. A guide plate that cooperates with a guide groove of the racetrack is provided on the carrier of the guide mechanism and current collectors that are supplied with power via the racetrack and are constructed as contact brushes are also provided on the carrier of the guide mechanism.

SUMMARY OF THE INVENTION

An object of the present invention is to provide a guide mechanism for a track-guided toy vehicle with which specific dynamic driving effects can be achieved while still retaining good functioning and ease of integration into the chassis.

This and other objects have been achieved by the fact that a swing arm, comprising the guide mechanism with the axis of rotation, the guide plate and the current collector elements, makes a contribution to the exemplary driving properties of the toy vehicle due to its ability to pivot about a horizontal axis and its inclined position in relation to the driving surface. The drive of the toy vehicle via the rear axle, for example, and the position as well as the function of the guide mechanism and/or the pivot arm in relation to the rear axle are essential parameters for the driving performance of the toy vehicle which can be influenced in a controlled manner through the variability in the position of the swing arm in the longitudinal direction of the vehicle. The magnet of the swing arm which is adjustable and the longitudinal direction of the vehicle also makes a contribution toward optimization of the driving performance.

The vertical axis of rotation of the guide mechanism is provided between a rear arm element and a front arm element of the swing arm, wherein the arm elements are implemented with a low complexity. The restoring device allows the guide mechanism to be moved into a basic position so that dynamic driving effects can be achieved and in particular the toy vehicle can be on the racetrack in a convenient manner. Finally, the housing with the slide of the guide mechanism contributes to the current collector elements being held in proper functioning position and also being easily interchangeable.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
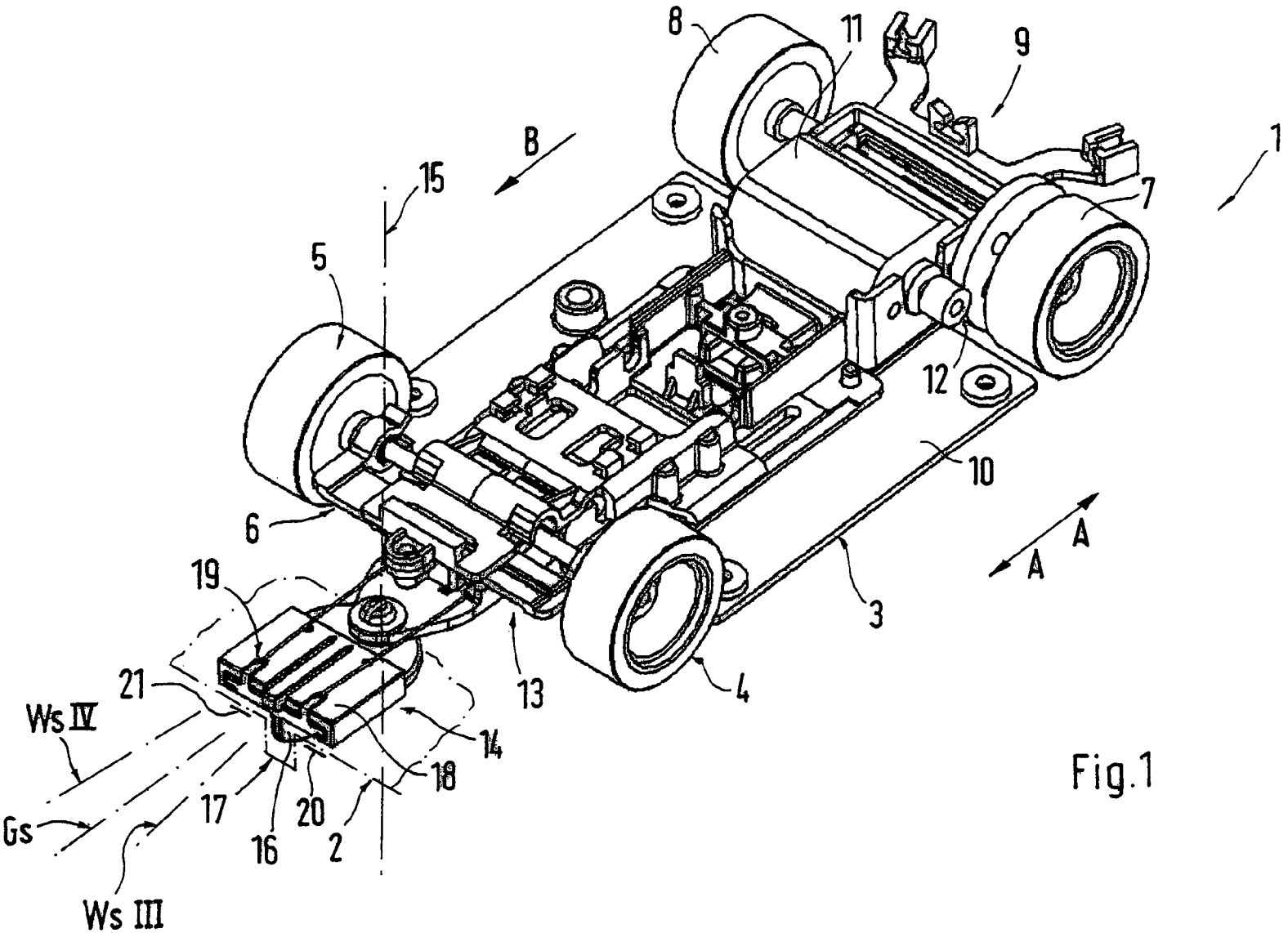
FIG. 1 is a perspective view from the front of a chassis of a toy vehicle with the guide mechanism according to the present invention.

A toy vehicle 1 is track guided, i.e., designed for operation on a road surface 2 embodied by, for example, a racetrack. The vehicle 1 includes a chassis 3 with a front axle unit 6 having front wheels 4, 5 and a rear axle unit 9 having rear wheels 7, 8. The front axle unit 6 and the rear axle unit 9 are connected in a modular fashion to a central frame 10 of the chassis 3 extending between the front wheels 4, 5 and the rear wheels 7, 8. An electric motor 11, which is installed in the chassis 3 transverse to the longitudinal direction A-A to drive the toy vehicle 1, acts via a gear train 12 on the rear wheels 7, 8 of the rear axle unit 9. The front area 13 (as seen in the direction of travel B) of the chassis 3 is provided with a guide mechanism 14, is pivotable about a vertical rotation axis 15 and is engaged with an upright guide plate 16 in a U-shaped guide groove 17 in the road surface 2. Current collector elements 18, 19 provided on both sides of the guide plate 16 cooperate with current rails 20, 21 in the road surface 2 and supply electricity to the electric motor 11.

Figure 2:
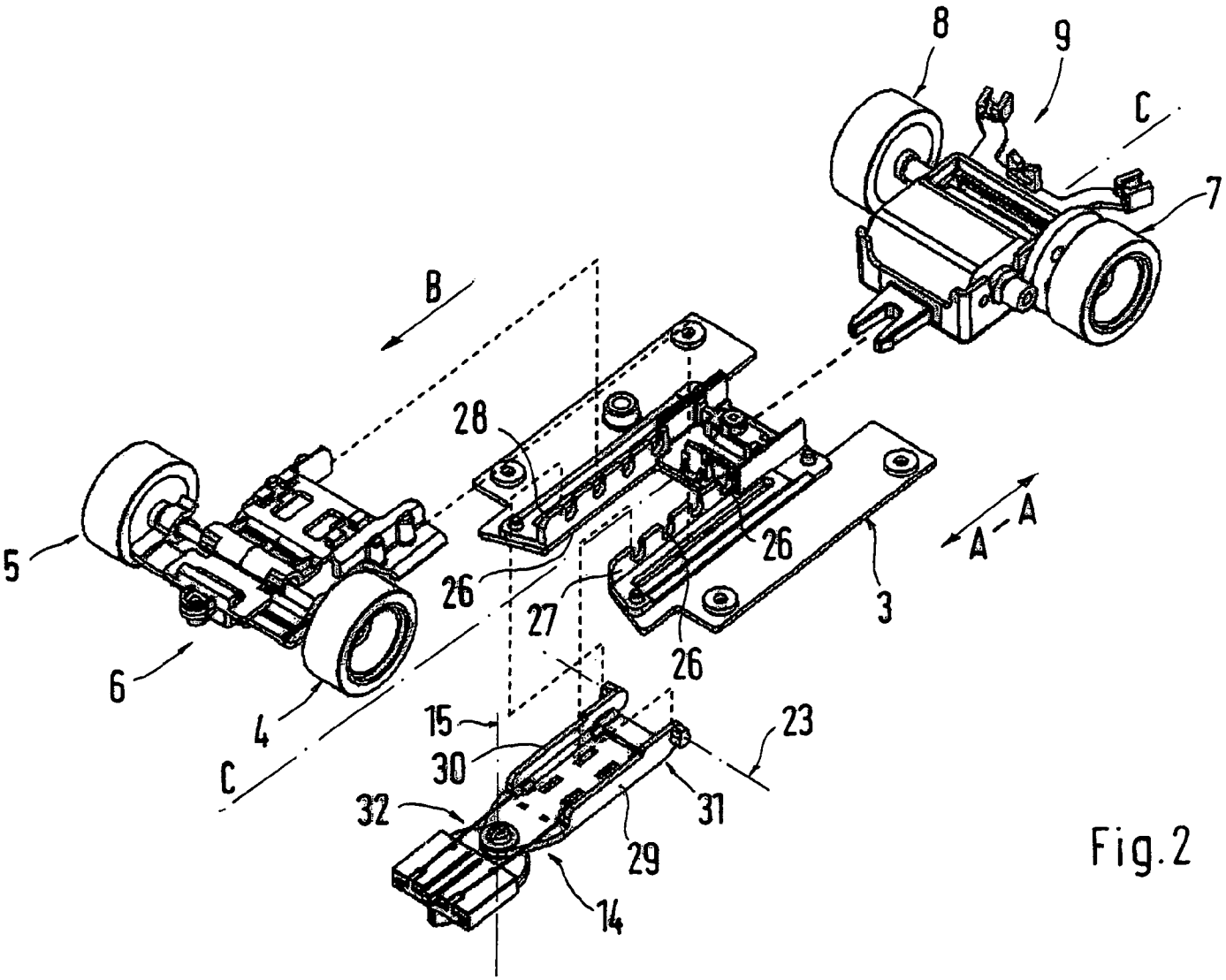
FIG. 2 is an exploded perspective view of the vehicle shown in FIG. 1.

A swing arm 22 (FIGS. 3-5) and a horizontal axis 23 (see also FIG. 2) are movably mounted on the chassis 3, comprising the guide mechanism 14 with the axis of rotation axis 15, the guide plate 16 and the current collector elements 18, 19. FIG. 1 shows the toy vehicle 1 elevated with respect to the road surface 2 and the swing arm 22 assuming a first angular position WsI; in the angular position II, the toy vehicle 1 is set down on the road surface. The swing arm 22 is mounted between the front wheels 4 and 5 and the rear wheels 7 and 8 but adjacent to the front wheels 4 and 5 on the chassis 3. The swing arm 22 runs obliquely from above, as seen in the direction of travel B, from the chassis 3 down to the road surface 2. In addition, the swing arm 22 is designed so that its position in the longitudinal direction A-A of the vehicle is variable so that the guide mechanism 14 is adjustable in relation to the rear wheels 7 and 8.

The swing arm 22, which is provided with axle journals 24 and 25 having pivot points DpI and DpII encompassing the axis 23, is adjustable in receptacles 26 of the chassis 3 arranged in succession, with axle journals enclosing the axis. The receptacles 26 are provided in supporting walls 27 and 28 equidistantly from a central longitudinal plane C-C of the toy vehicle 1. The supporting walls 27 and 28 border the guide walls 29 and 30 which support the axle journals 24 and 25. To simplify the adjustment of the guide mechanism 14, the axle journals 24 and 25 and the receptacles 26 cooperate via a clip device. The axle journals 24 and 25 are inserted from above into the receptacles 26 which are open toward the top.

The swing arm 22 has a rear arm element 31 and a front arm element 32, the guide walls 29 and 30 being arranged on said rear arm element 31. The rear arm element 31 is connected to the front arm element 32 with the vertical axis of rotation 15 connected in between. In addition, the rear arm element 31 has a first bearing section 33 and the front arm element 32 has a second bearing section 34, whereby the bearing distances 33 and 34 overlap and are held in position by a screw connection 35.

Figure 4:
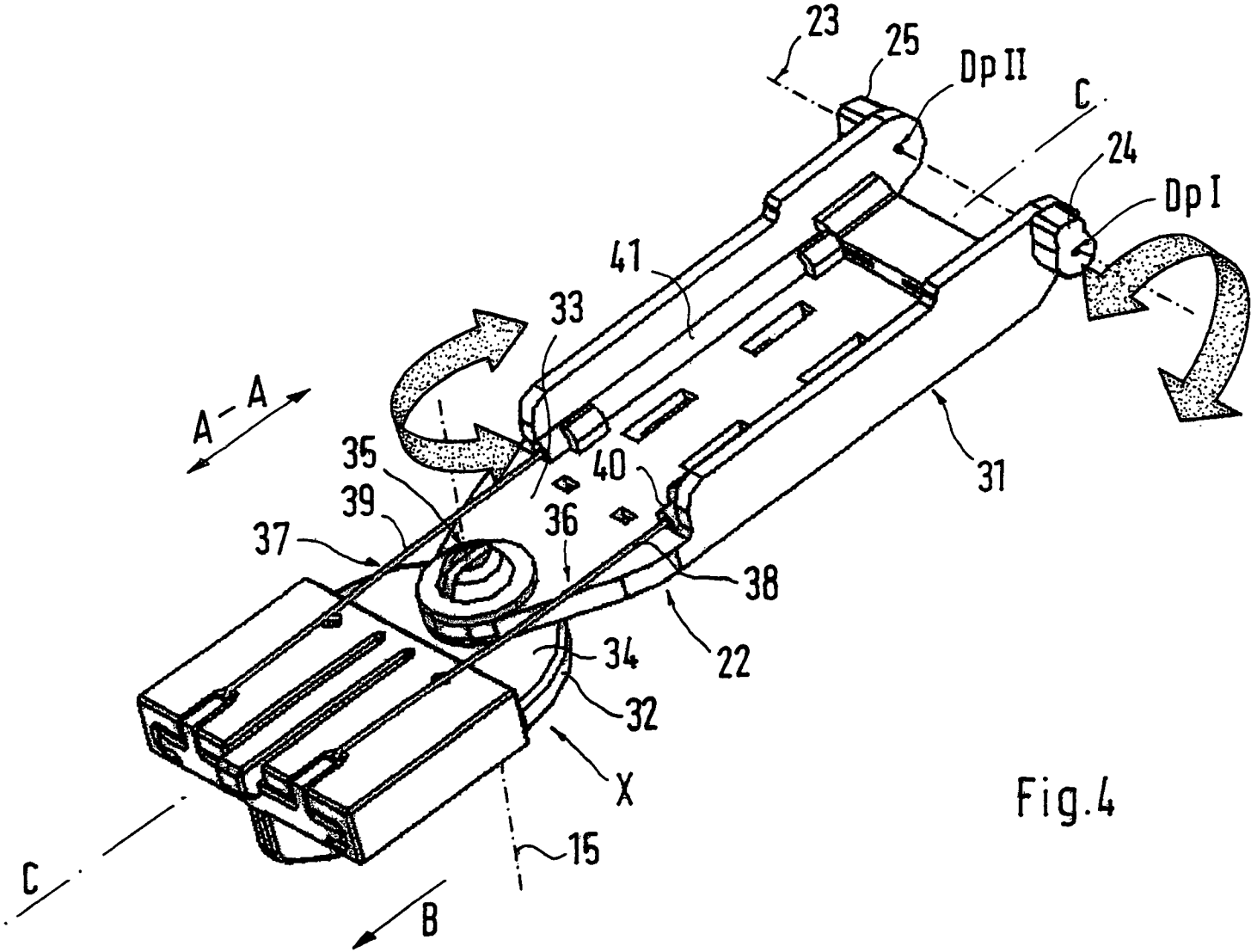
FIG. 4 is a perspective view from the left front of the guide mechanism.

In operation of the toy vehicle 1, the guide mechanism 14 which is pivotable about the vertical rotation axis 15 is moved within the angular positions WsIII, WsIV, which is why a resilient restoring device 36 acting on the guide mechanism 14 is operative between the front arm element 32 and the rear arm element 31, attempting to move the guide mechanism 14 into a basic position Gs which encompasses the middle longitudinal plane C-C (FIG. 4). The restoring device 36 is formed by a spring wire mechanism 37 which includes two spring wires 38, 39 equidistant from the central longitudinal plane C-C. The spring wires 38, 39 are rigidly connected to the front arm element 32 at one end and to the rear arm element 31 at the other end. The spring wires 38, 39 are inserted at their rear arm element 31 into tubular bodies 40, 41 which are installed along the inside of the respective guide walls 29, 30. The spring wires 38, 39 and the tubular bodies 40, 41 are connected as respective current transfer elements to the current collector elements 18, 19.

Figure 3:
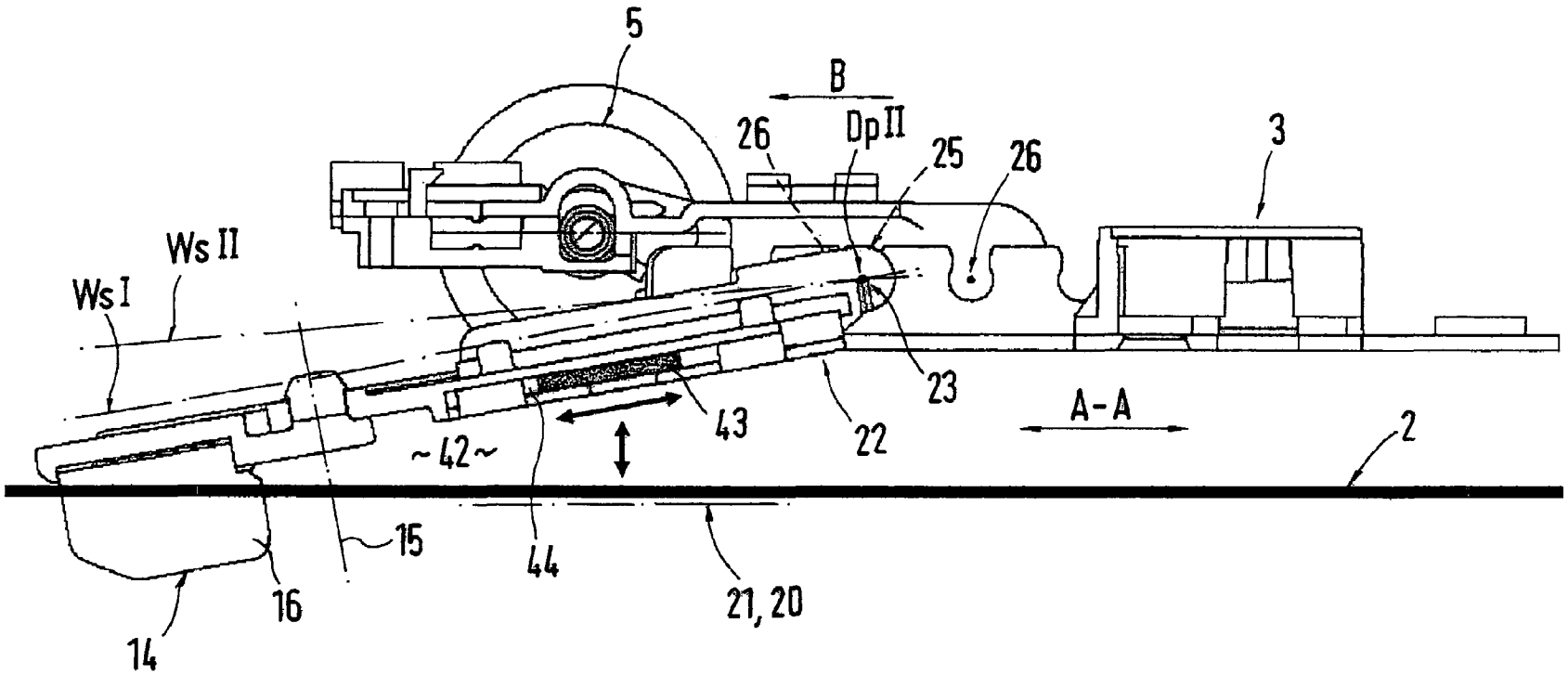
FIG. 3 is a partial side view of FIG. 1 with the guide mechanism.

As shown in FIG. 3, on a side 42 facing the road surface 2, the swing arm 22 is provided with a magnet 43 which, in combination with the current rails 20, 21, creates a magnetic field optimizing its output for the toy vehicle 1. To allow variation of this effect of the magnetic field, the magnet 43 is adjustable in the longitudinal direction A-A of the vehicle by way of an adjusting device 44 of the swing arm 22.

Figure 5:
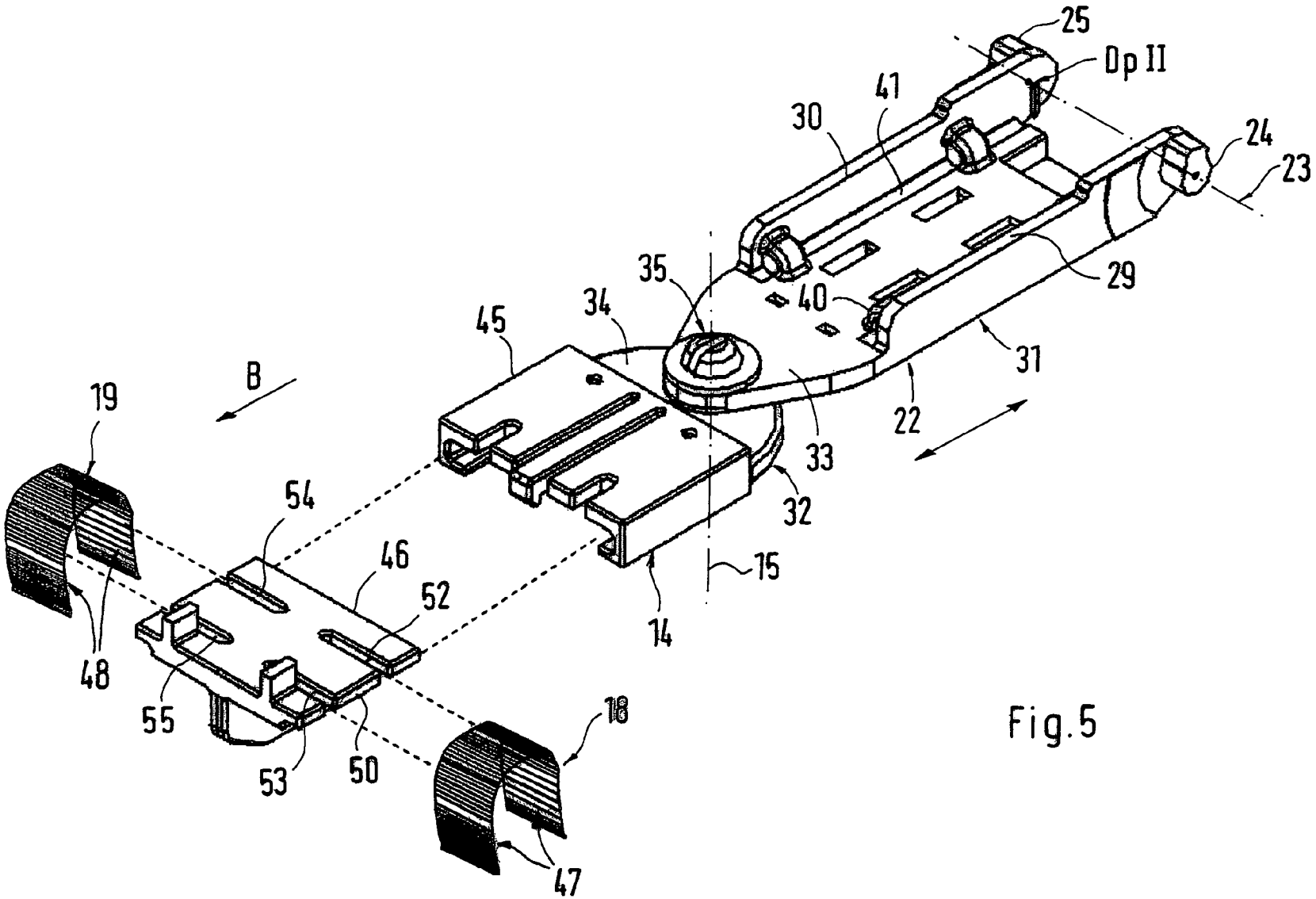
FIG. 5 is a view similar to FIG. 4 but with an exploded detailed view at region X in FIG. 4.

The guide mechanism 14 has a housing 45 with a drawer-like slide 46 (FIG. 5). The current collector elements 18, 19, which cooperate with the current rails 20, 21 of the road surface 2 and have contact lugs 47, 48, are secured between the slide 46 and the housing 45 and are in operative connection with the spring wires 38, 39 (FIG. 4 and FIG. 5). The slide 46 is provided with thrust journals 49, 50 and receptacle slots 52, 53 and 54, 55 extending across the longitudinal direction A-A of the vehicle. The strip-like current collector elements 18, 19 are wrapped around the respective thrust journals 49, 50 and penetrate through the respective receptacle slots 51, 52 and 53, 54, ultimately coming in contact with the current rails 20, 21 of the road surface 2.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

We claim:

1. Guide mechanism for a track-guided toy vehicle equipped with an electric motor and operational on a road surface with a guide groove, the guide mechanism being mounted via a vertical rotation axis on a chassis of the toy vehicle engaging with a guide plate in the guide groove and having electric motor current collector elements cooperating with current rails in the road surface, comprising a swing arm arranged to be pivotable about a horizontal rotation axis and arranged on a chassis of the toy vehicle and a magnet adjustable in a longitudinal direction of the toy vehicle, said chassis being arranged on the road surface via front and rear wheels and said swing arm including the guide mechanism with the vertical rotation axis, the guide plate and the current collector elements wherein spring wires and tubular bodies are connected as current transfer elements to the current collector elements.

2. The guide mechanism of claim 1, wherein the swing arm is arranged to run obliquely from said chassis to the road surface as seen in a direction of travel of the toy vehicle.

3. The guide mechanism of claim 1, wherein the swing arm is configured to be variably positioned in relation to a longitudinal direction of the toy vehicle.

4. The guide mechanism of claim 1, wherein the swing arm together with axle journals enclosing the horizontal rotation axis is adjustably arranged in receptacles of said chassis.

5. The guide mechanism of claim 4, wherein the receptacles are provided in supporting walls of said chassis, said supporting walls running equidistantly from a central longitudinal plane of the toy vehicle and bordering swing arms guide walls of which carry the axle journals.

6. The guide mechanism of claim 4, wherein a clip device is provided for cooperation between the axle journals and the receptacles.

7. The guide mechanism of claim 1, wherein the guide walls are provided on a rear arm element and are_arranged to cooperate with a front arm element of the guide mechanism with intermediate involvement of the vertical rotation.

8. The guide mechanism of claim 7, wherein the rear arm element has a first bearing section and the front arm element has a second bearing section, which bearing sections overlap each other and are held together in position by a screw connection.

9. The guide mechanism of claim 7, wherein a resilient restoring device is arranged to bias the guide mechanism out of angular positions into a position in a longitudinal plane of the toy vehicle.

10. The guide mechanism of claim 9, wherein the restoring device comprises a spring wire device operative between the front arm element and the rear arm element.

11. The guide mechanism of claim 10, wherein the spring wire device comprises two spring wires running equidistantly from a central longitudinal plane of the toy vehicle and being connected at one end thereof to the front arm element and being held at another end thereof in tubular bodies of the rear arm element.

12. The guide mechanism of claim 11, wherein spring wires and the tubular bodies are connected as current transfer elements to the current collector elements.

13. The guide mechanism of claim 1, wherein the swing arm includes the magnet which is arranged on a side facing the road surface.

14. The guide mechanism of claim 1, wherein the guide mechanism includes a housing having a drawer-like slide, with the current collector elements that cooperate with the current rails of the road surface having contact lugs secured between the slide and the housing.

15. The guide mechanism of claim 14, wherein the slide comprises thrust journals and receptacle slots configured such that the current collector elements having a strip-like configuration are wrapped around thrust journals and penetrate through receptacle slots.

16. The guide mechanism of claim 15, wherein the spring wires and the current collector elements are operatively connected in a housing of the guide mechanism.

17. The guide mechanism of claim 15, wherein spring wires are connected as current transfer elements to the current collector elements.

* * * * *